US007977420B2

(12) United States Patent
Nielson et al.

(10) Patent No.: US 7,977,420 B2
(45) Date of Patent: Jul. 12, 2011

(54) REACTIVE MATERIAL COMPOSITIONS, SHOT SHELLS INCLUDING REACTIVE MATERIALS, AND A METHOD OF PRODUCING SAME

(75) Inventors: Daniel B. Nielson, Tremonton, UT (US); Richard M. Truitt, Champlin, MN (US); Rochelle D. Poore, Andover, MN (US); Benjamin N. Ashcroft, Perry, UT (US)

(73) Assignee: Alliant Techsystems Inc., Minneapolis, MN (US)

( * ) Notice: Subject to any disclaimer, the term of this patent is extended or adjusted under 35 U.S.C. 154(b) by 1006 days.

(21) Appl. No.: 11/690,016

(22) Filed: Mar. 22, 2007

(65) Prior Publication Data

US 2007/0272112 A1 Nov. 29, 2007

Related U.S. Application Data

(63) Continuation-in-part of application No. 10/462,437, filed on Jun. 16, 2003, now Pat. No. 7,307,117, which is a continuation of application No. 09/789,479, filed on Feb. 21, 2001, now Pat. No. 6,593,410, application No. 11/690,016, which is a continuation-in-part of application No. 10/801,948, filed on Mar. 15, 2004, now abandoned, which is a continuation-in-part of application No. 10/801,946, filed on Mar. 15, 2004, now abandoned, which is a continuation-in-part of application No. 11/079,925, filed on Mar. 14, 2005, now Pat. No. 7,603,951, application No. 11/690,016, which is a continuation-in-part of application No. 11/538,763, filed on Oct. 4, 2006, application No. 11/690,016, which is a continuation-in-part of application No. 11/512,058, filed on Aug. 29, 2006, now Pat. No. 7,614,348.

(60) Provisional application No. 60/184,316, filed on Feb. 23, 2000, provisional application No. 60/553,430, filed on Mar. 15, 2004, provisional application No. 60/723,465, filed on Oct. 4, 2005.

(51) Int. Cl.
*C08K 3/08* (2006.01)

(52) U.S. Cl. ..... 524/439; 524/440; 524/441; 524/442

(58) Field of Classification Search ..... 524/439–442
See application file for complete search history.

(56) References Cited

U.S. PATENT DOCUMENTS

| | | | |
|---|---|---|---|
| 359,491 | A | 3/1887 | Bagger |
| 2,217,645 | A | 10/1940 | DeWilde et al. |
| 2,398,287 | A | 4/1946 | Christie |
| 2,446,268 | A | 8/1948 | Dawson |
| 2,703,531 | A | 8/1948 | Graumann et al. |
| 2,961,712 | A | 11/1960 | Davis |
| 3,133,841 | A | 5/1964 | Kuehl |
| 3,158,994 | A | 12/1964 | Hodgson |
| 3,325,316 | A | 6/1967 | MacDonald |
| 3,414,443 | A | 12/1968 | Pheasant et al. |
| 3,434,420 | A | 3/1969 | Ciccone et al. |
| 3,463,047 | A | 8/1969 | Germershausen |
| 3,669,020 | A | 6/1972 | Waite et al. |
| 3,677,183 | A | 7/1972 | Talley |
| 3,730,093 | A | 5/1973 | Cummings |
| 3,745,076 | A | 7/1973 | Sickman |
| 3,770,525 | A | 11/1973 | Villey-Desmeserets et al. |
| 3,799,054 | A | 3/1974 | LaRocca |
| 3,894,867 | A | 7/1975 | Fishman et al. |
| 3,951,068 | A | 4/1976 | Schroeder |
| 3,961,576 | A | 6/1976 | Montgomery, Jr. |
| 3,978,796 | A | 9/1976 | Hackman |
| 3,980,612 | A | 9/1976 | Gangal |
| 4,006,687 | A | 2/1977 | Ridgeway |
| 4,011,818 | A | 3/1977 | Stosz, Jr. et al. |
| 4,029,868 | A | 6/1977 | Carlson |
| 4,037,539 | A | 7/1977 | Hackman |
| 4,106,411 | A | 8/1978 | Borcher et al. |
| 4,112,846 | A | 9/1978 | Gilbert et al. |
| 4,131,498 | A | 12/1978 | Lucy |
| 4,153,661 | A | 5/1979 | Ree et al. |
| 4,179,992 | A | 12/1979 | Ramnarace et al. |
| 4,237,787 | A | 12/1980 | Wacula et al. |
| 4,280,408 | A | 7/1981 | Weber et al. |
| 4,331,080 | A | 5/1982 | West et al. |
| 4,348,958 | A | 9/1982 | Day |
| 4,351,240 | A | 9/1982 | McCubbin et al. |
| 4,368,296 | A | 1/1983 | Kuhls et al. |
| 4,381,692 | A | 5/1983 | Weintraub |

(Continued)

FOREIGN PATENT DOCUMENTS

| | | |
|---|---|---|
| DE | 315857 | 6/1920 |

(Continued)

OTHER PUBLICATIONS

Search Report for French Application No. 0502374, dated Oct. 24, 2007.

Search Report for French Application No. 0502373, dated Oct. 18, 2007.

PCT International Search Report for International Application No. PCT/US2007/076672, mailed Jul. 28, 2008.

3M Material Safety Data Sheet, pp. 1-7, ©2005, 3M Company.

Fischer, S.H., et al., "Theoretical Energy Release of Thermites, Intermetallics, and Combustible Metals," To be presented at the 24th International Pyrotechnics Seminar, Monterey, CA, Jul. 1998, 61 pages.

(Continued)

*Primary Examiner* — Edward J Cain
(74) *Attorney, Agent, or Firm* — TraskBritt

(57) ABSTRACT

A reactive material that includes at least one binder and at least one fuel, at least one oxidizer, or combinations thereof; at least one metal and at least one fuel; or at least two fuels. The reactive material is used in a reactive material shot shell in which at least a portion of a slug, shot, or combinations thereof are formed from the reactive material.

45 Claims, 1 Drawing Sheet

U.S. PATENT DOCUMENTS

| | | | | |
|---|---|---|---|---|
| 4,419,936 | A | | 12/1983 | Coates et al. |
| 4,432,816 | A | | 2/1984 | Kennedy et al. |
| 4,435,481 | A | | 3/1984 | Baldi |
| 4,449,456 | A | | 5/1984 | Foss et al. |
| 4,503,776 | A | | 3/1985 | Nussbaum et al. |
| 4,572,077 | A | | 2/1986 | Antoine et al. |
| 4,612,860 | A | | 9/1986 | Flatau |
| 4,655,139 | A | | 4/1987 | Wilhelm |
| 4,662,280 | A | | 5/1987 | Becker et al. |
| 4,665,113 | A | | 5/1987 | Eberl |
| 4,693,181 | A | | 9/1987 | Dadley et al. |
| H000540 | H | | 11/1988 | Caponi |
| 4,807,795 | A | | 2/1989 | LaRocca et al. |
| 4,853,294 | A | | 8/1989 | Everett et al. |
| 4,955,939 | A | | 9/1990 | Petrousky et al. |
| 4,958,570 | A | | 9/1990 | Harris |
| 4,970,960 | A | | 11/1990 | Feldmann |
| 4,985,190 | A | | 1/1991 | Ishikawa et al. |
| 5,045,114 | A | * | 9/1991 | Bigalk et al. ..... 106/404 |
| 5,049,212 | A | | 9/1991 | Colick |
| 5,055,539 | A | | 10/1991 | Hengel et al. |
| 5,067,995 | A | | 11/1991 | Nutt |
| H001047 | H | | 5/1992 | Henderson et al. |
| 5,157,225 | A | | 10/1992 | Adams et al. |
| 5,175,392 | A | | 12/1992 | Denis |
| 5,198,616 | A | | 3/1993 | Anderson |
| 5,259,317 | A | | 11/1993 | Lips |
| 5,313,890 | A | | 5/1994 | Cuadros |
| 5,323,707 | A | | 6/1994 | Norton et al. |
| 5,339,624 | A | | 8/1994 | Calsson et al. |
| 5,411,615 | A | | 5/1995 | Sumrail et al. |
| H001504 | H | | 12/1995 | Crabtree |
| 5,472,536 | A | | 12/1995 | Doris et al. |
| 5,474,625 | A | | 12/1995 | Duong et al. |
| 5,518,807 | A | | 5/1996 | Chan et al. |
| 5,531,844 | A | | 7/1996 | Brown et al. |
| 5,535,679 | A | | 7/1996 | Craddock |
| 5,549,948 | A | | 8/1996 | Blong et al. |
| 5,627,339 | A | | 5/1997 | Brown et al. |
| 5,672,843 | A | | 9/1997 | Evans et al. |
| 5,710,217 | A | | 1/1998 | Blong et al. |
| 5,763,519 | A | | 6/1998 | Springsteen |
| 5,792,977 | A | | 8/1998 | Chawla |
| 5,801,325 | A | | 9/1998 | Willer et al. |
| 5,811,726 | A | | 9/1998 | Brown et al. |
| 5,852,256 | A | | 12/1998 | Hornig |
| 5,886,293 | A | | 3/1999 | Nauflett et al. |
| 5,910,638 | A | | 6/1999 | Spencer et al. |
| 5,913,256 | A | | 6/1999 | Lowden et al. |
| 5,945,629 | A | | 8/1999 | Schildknecht et al. |
| 6,042,702 | A | | 3/2000 | Kolouch et al. |
| 6,105,505 | A | | 8/2000 | Jones |
| 6,115,894 | A | | 9/2000 | Huffman |
| 6,119,600 | A | | 9/2000 | Burri |
| 6,132,536 | A | | 10/2000 | Hohmann et al. |
| 6,186,072 | B1 | | 2/2001 | Hickerson, Jr. et al. |
| 6,293,201 | B1 | | 9/2001 | Consaga |
| 6,308,634 | B1 | | 10/2001 | Fong |
| 6,315,847 | B1 | | 11/2001 | Lee et al. |
| 6,334,394 | B1 | | 1/2002 | Zimmermann et al. |
| 6,354,222 | B1 | | 3/2002 | Becker et al. |
| 6,363,828 | B1 | | 4/2002 | Sherlock et al. |
| 6,371,219 | B1 | | 4/2002 | Collins et al. |
| 6,427,599 | B1 | | 8/2002 | Posson et al. |
| 6,439,315 | B2 | | 8/2002 | Onuki |
| 6,484,642 | B1 | | 11/2002 | Kuhns et al. |
| 6,485,586 | B1 | | 11/2002 | Gill et al. |
| 6,536,351 | B2 | | 3/2003 | Böcker et al. |
| 6,547,993 | B1 | | 4/2003 | Joshi |
| 6,588,344 | B2 | | 7/2003 | Clark et al. |
| 6,593,410 | B2 | | 7/2003 | Nielson et al. |
| 6,659,013 | B1 | | 12/2003 | Kellner |
| 6,679,176 | B1 | | 1/2004 | Zavitsanos et al. |
| 6,799,518 | B1 | | 10/2004 | Williams |
| 6,832,740 | B1 | | 12/2004 | Ransom |
| 6,846,372 | B1 | | 1/2005 | Guirguis |
| 6,896,751 | B2 | | 5/2005 | Posson et al. |
| 6,945,175 | B1 | | 9/2005 | Gotzmer et al. |
| 6,962,634 | B2 | * | 11/2005 | Nielson et al. ..... 149/19.3 |
| 7,000,547 | B2 | | 2/2006 | Amick |
| 7,017,496 | B2 | | 3/2006 | Lloyd |
| 7,040,235 | B1 | | 5/2006 | Lloyd |
| 7,143,698 | B2 | | 12/2006 | Lloyd |
| 7,191,709 | B2 | | 3/2007 | Nechitailo |
| 7,194,961 | B1 | | 3/2007 | Nechitailo |
| 7,231,876 | B2 | | 6/2007 | Kellner |
| 7,278,353 | B2 | | 10/2007 | Langan et al. |
| 7,278,354 | B1 | | 10/2007 | Langan et al. |
| 7,307,117 | B2 | | 12/2007 | Nielson et al. |
| 7,380,503 | B2 | | 6/2008 | Williams et al. |
| 7,603,951 | B2 | | 10/2009 | Rose et al. |
| 7,614,348 | B2 | | 11/2009 | Truitt et al. |
| 7,621,222 | B2 | | 11/2009 | Lloyd |
| 2003/0051629 | A1 | | 3/2003 | Zavitsanos et al. |
| 2003/0140811 | A1 | | 7/2003 | Bone |
| 2004/0020397 | A1 | | 2/2004 | Nielson et al. |
| 2004/0116576 | A1 | | 6/2004 | Nielson et al. |
| 2005/0067072 | A1 | | 3/2005 | Vavrick |
| 2005/0087088 | A1 | | 4/2005 | Lacy et al. |
| 2005/0183618 | A1 | | 8/2005 | Nechitailo |
| 2005/0199323 | A1 | | 9/2005 | Nielson et al. |
| 2006/0011086 | A1 | | 1/2006 | Rose et al. |
| 2006/0086279 | A1 | | 4/2006 | Lloyd |
| 2006/0144281 | A1 | | 7/2006 | Williams et al. |
| 2007/0272112 | A1 | | 11/2007 | Nielson et al. |
| 2007/0277914 | A1 | | 12/2007 | Hugus et al. |
| 2008/0202373 | A1 | | 8/2008 | Hugus et al. |
| 2009/0211484 | A1 | | 8/2009 | Truitt et al. |
| 2009/0320711 | A1 | | 12/2009 | Lloyd |

FOREIGN PATENT DOCUMENTS

| | | | |
|---|---|---|---|
| DE | 10224503 | A | 12/2002 |
| EP | 0 487 472 | A1 | 5/1992 |
| EP | 0 487 473 | A1 | 5/1992 |
| EP | 0 684 938 | B1 | 12/1995 |
| EP | 0770449 | A1 | 5/1997 |
| FR | 856233 | | 6/1940 |
| FR | 2749382 | A1 | 12/1997 |
| GB | 384966 | A | 12/1932 |
| GB | 488909 | A | 7/1938 |
| GB | 588671 | A | 11/1944 |
| GB | 968507 | A | 11/1960 |
| GB | 1 591 092 | A | 6/1981 |
| RU | 2100763 | C1 | 12/1997 |
| WO | WO 93/21135 | A1 | 10/1993 |
| WO | WO 96/07700 | A | 3/1996 |
| WO | 9918050 | A1 | 4/1999 |
| WO | 0200741 | | 1/2002 |
| WO | 0240213 | A1 | 5/2002 |

OTHER PUBLICATIONS

Indium Corporation of America, Europe and Asia, Indalloy Speciality Alloys, Mechanical Properties, as viewed at 222. indium.com on Aug. 7, 2006.

Reactive Materials, Advanced Energetic Materials (2004), http://www.nap.com, ©2004, 2001 The National Academy of Sciences, pp. 20-23.

U.S. Appl. No. 10/801,946, filed Mar. 15, 2004, entitled "Reactive Compositions Including Metal and Methods of Forming Same."

U.S. Appl. No. 11/512,058, filed Aug. 29, 2006, entitled Weapons and Weapon Components Incorporating Reactive Materials and Related Methods.

U.S. Appl. No. 11/538,763, filed Oct. 4, 2006, entitled Reactive Material Enhanced Projectiles and Related Methods.

DuPont Fluoropolymers Food Processing and Industrial Bakeware Coatings http://www.dupont.com/teflon/bakeware/power.html © 2003 E.I. DuPont de Nemours and Company.

DuPont Teflon® Industrial Coatings http://www.dupont.com/teflon/coatings/basic_types.html © 2003 E.I. DuPont de Nemours and Company.

HACKH'S Chemical Dictionary 4th Ed. Dec. 4, 1974 p. 663.

Lycos Wired News Adding More Bang to Navy Missiles 5 pages Dec. 26, 2002 http://wired.com.

Partial European Search Report dated Jul. 20, 2004.

Partial European Search Report for European Application No. 06020829 dated Oct. 30, 2007.
Patriot Advanced Capability-3 (PAC-3) 17 pages Various Dates as viewed at http://www.missilethreat.com.on Nov. 27, 2006.
Patriot Air & Missile Defense System: How Patriot Works http://static.howstuffworks.com © 2002 Raytheon Company.
Reactive Tungsten Alloy for Inert Warheads Navy SBIR FY2004.2 1 page.
Search Report dated Nov. 8, 2005 prepared by the EPO for the French Patent Office.
SpaceRef.com Better Warheads Through Plastics from Defense Advanced Research Projects Agency (DARPA) 2 pages Dec. 2 2002 http://www.spaceref.com.
The Ordnance Shop Sidewinder Guided Missile 3 pages as viewed at http://www.ordnance.org on Jul. 26, 2006.
UK Search Report of Jul. 1, 2005.
UK Search Report of Jun. 29, 2005.
UK Search Report of Jun. 8, 2005.
Zumdahl Steven S. "Chemistry" pp. 931-934 (no date).

* cited by examiner

REACTIVE MATERIAL COMPOSITIONS, SHOT SHELLS INCLUDING REACTIVE MATERIALS, AND A METHOD OF PRODUCING SAME

CROSS-REFERENCE TO RELATED APPLICATIONS

This application is a continuation-in-part of U.S. patent application Ser. No. 10/462,437, entitled "High Strength Reactive Materials And Methods Of Making," filed Jun. 16, 2003, now U.S. Pat. No. 7,307,117, issued Dec. 11, 2007, which is a continuation of U.S. patent application Ser. No. 09/789,479, entitled "High Strength Reactive Materials," filed Feb. 21, 2001, now U.S. Pat. No. 6,593,410, issued Jul. 15, 2003, which claims the benefit of U.S. Provisional Patent Application Ser. No. 60/184,316, filed Feb. 23, 2000; a continuation-in-part of U.S. patent application Ser. No. 10/801,948 entitled "Reactive Material Enhanced Munition Compositions and Projectiles Containing Same," filed Mar. 15, 2004, now abandoned; a continuation-in-part of U.S. patent application Ser. No. 10/801,946, entitled "Reactive Compositions Including Metal and Methods of Forming Same," filed Mar. 15, 2004, now abandoned; a continuation-in-part of U.S. patent application Ser. No. 11/079,925, entitled "Reactive Material Enhanced Projectiles and Related Methods," filed Mar. 14, 2005, now U.S. Pat. No. 7,603,951, issued Oct. 20, 2009, which claims the benefit of U.S. Provisional Patent Application Ser. No. 60/553,430, filed Mar. 15, 2004; a continuation-in-part of U.S. patent application Ser. No. 11/538,763, entitled "Reactive Material Enhanced Projectiles And Related Methods," filed Oct. 4, 2006, pending, which claims the benefit of U.S. Provisional Patent Application Ser. No. 60/723,465, filed Oct. 4, 2005; and a continuation-in-part of U.S. patent application Ser. No. 11/512,058 entitled "Weapons And Weapon Components Incorporating Reactive Materials And Related Methods," filed Aug. 29, 2006, now U.S. Pat. No. 7,614,348, issued Nov. 10, 2009, each of which is assigned to the assignee hereof, and the disclosure of each of which is incorporated by reference herein in its entirety.

The present application is also related to U.S. Provisional Patent Application No. 60/368,284, filed Mar. 28, 2002, entitled "Low Temperature, Extrudable, High Density Reactive Materials," now abandoned; U.S. Pat. No. 6,962,634, issued Nov. 8, 2005, entitled "Low Temperature, Extrudable, High Density Reactive Materials"; U.S. patent application Ser. No. 12/507,605, filed Jul. 22, 2009, entitled "Low Temperature, Extrudable, High Density Reactive Materials," pending; U.S. patent application Ser. No. 11/620,205, filed Jan. 5, 2007, entitled "Reactive Compositions Including Metal," pending; U.S. patent application Ser. No. 12/127,627, filed May 27, 2008, entitled "Reactive Material Enhanced Munition Compositions and Projectiles Containing Same," pending; and U.S. patent application Ser. No. 11/697,005, filed Apr. 5, 2007, entitled "Consumable Reactive Material Fragments, Ordnance Incorporating Structures For Producing The Same, And Methods Of Creating The Same," pending.

FIELD OF THE INVENTION

Embodiments of the present invention relate to a reactive material and to a reactive material used in a shot shell. More specifically, embodiments of the present invention relate to the reactive material that includes at least one binder and at least one fuel, at least one oxidizer, or combinations thereof; at least one metal and at least one fuel; or at least two fuels.

Embodiments of the present invention also relate to shot shells that include the reactive material as at least a portion of a slug, shot, or combinations thereof.

BACKGROUND OF THE INVENTION

Shot shells conventionally include nonreactive shot or nonreactive slugs made from steel, tungsten, lead, or combinations thereof. The military and law enforcement use shot shells to breach doors or other targets by firing the shot shell at the door, lock, handle, or hinges to gain entry. Ideally, shot shells for use in door-breaching applications are safe to the shooter, penetrate the target, and do not cause injury or damage to persons or structures located beyond three feet of the opposite side of the target. In addition, the shot shells should not produce lethal fragments upon impact with the target. However, conventional shotgun shells do not breach doors readily, produce ricochet and back spray, have no stand-off breaching capability, and are relatively ineffective at damaging hinges.

U.S. Pat. No. 4,419,936 describes a projectile that includes a reactive material. The projectile is formed in whole or in part from a pyrophoric metal, such as iron-cerium alloys, zirconium, or depleted uranium. The projectile includes fragments formed from magnesium and TEFLON®. Alternatively, the projectile uses an incendiary material in the explosive matrix or as a separate composition located within or adjacent to the explosive fill of the projectile.

U.S. Pat. No. 6,679,176 describes a projectile that includes a reactive composition that contains a reactive metal and an oxidizer. The reactive metal is titanium, aluminum, magnesium, lithium, boron, beryllium, zirconium, thorium, uranium, hafnium, alloys thereof, hydrides thereof, and combinations thereof. The oxidizer is lithium perchlorate, lithium chlorate, magnesium perchlorate, magnesium chlorate, ammonium perchlorate, ammonium chlorate, potassium perchlorate, potassium chlorate, and combinations thereof. A binder, such as a fluorinated polymer, is optionally present. The projectile is used to destruct unexploded ordnance.

BRIEF SUMMARY OF THE INVENTION

One embodiment of the present invention comprises a composition for a reactive material that includes at least one fuel and an epoxy resin selected from the group consisting of a diglycidyl ether of bisphenol A, and a diglycidyl ether of bisphenol F.

Another embodiment of the present invention comprises a composition for a reactive material that includes at least one terpolymer of tetrafluoroethylene, hexafluoropropylene, and vinylidene fluoride and osmium.

Another embodiment of the present invention comprises a composition for a reactive material that includes at least one fuel and a fluorinated polymer of perfluoropolyether.

Another embodiment of the present invention comprises a composition for a reactive material that includes at least one fuel and perfluorosuccinyl polyether di-alcohol.

Another embodiment of the present invention comprises a composition for a reactive material that consists of at least one fuel selected from the group consisting of tantalum and iron and at least one oxidizer selected from the group consisting of potassium perchlorate, tungsten trioxide, tungsten dioxide, and iron oxide.

Another embodiment of the present invention comprises a composition for a reactive material that consists essentially of at least two fuels selected from the group consisting of zirconium, aluminum, titanium, nickel, copper, tungsten, and iron.

Another embodiment of the present invention comprises a shot shell that includes a case and at least one of the following components: a slug and shot. At least a portion of at least one of the slug and the shot is formed from a reactive material. The reactive material includes reactive material components from at least two of the following three component categories: at least one fuel, at least one oxidizer, and at least one binder.

Another embodiment of the present invention comprises a method of producing a shot shell. The method comprises producing a reactive material that includes reactive material components from at least two of the following three component categories: at least one fuel, at least one oxidizer, and at least one binder. The reactive material is formed into at least a portion of at least one of a slug and shot.

BRIEF DESCRIPTION OF THE DRAWINGS

While the specification concludes with claims particularly pointing out and distinctly claiming that which is regarded as the present invention, the advantages of this invention may be more readily ascertained from the following description of the invention when read in conjunction with the accompanying drawings in which:

DETAILED DESCRIPTION OF THE INVENTION

As used herein, the terms "comprising," "including," "containing," "characterized by," and grammatical equivalents thereof are inclusive or open-ended terms that do not exclude additional, unrecited elements or method steps, but also include the more restrictive terms "consisting of" and "consisting essentially of" and grammatical equivalents thereof As used herein, the term "may" with respect to a material, structure, feature or method act indicates that such is contemplated for use in implementation of an embodiment of the invention and such term is used in preference to the more restrictive term "is" so as to avoid any implication that other, compatible materials, structures, features and methods usable in combination therewith should or must be, excluded.

Figure 1:
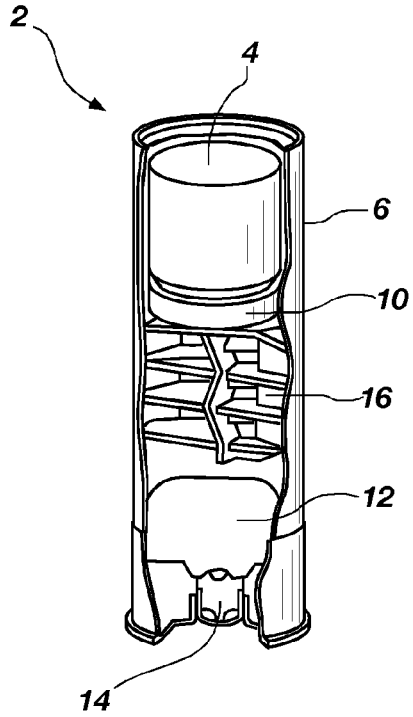
FIGS. 1-3 are cross-sectional views of embodiments of shot shells according to the present invention.
Figure 3:
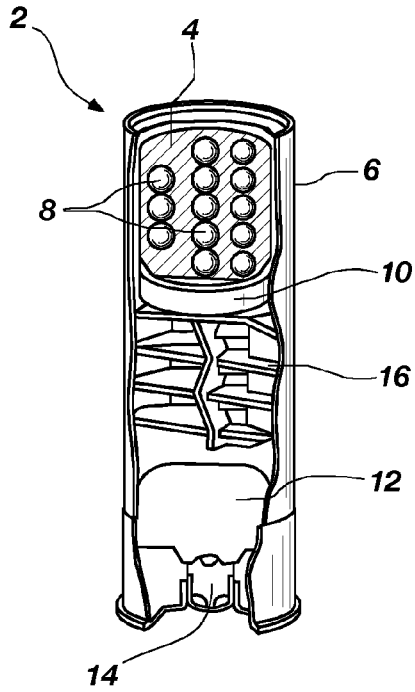
Figure 2:
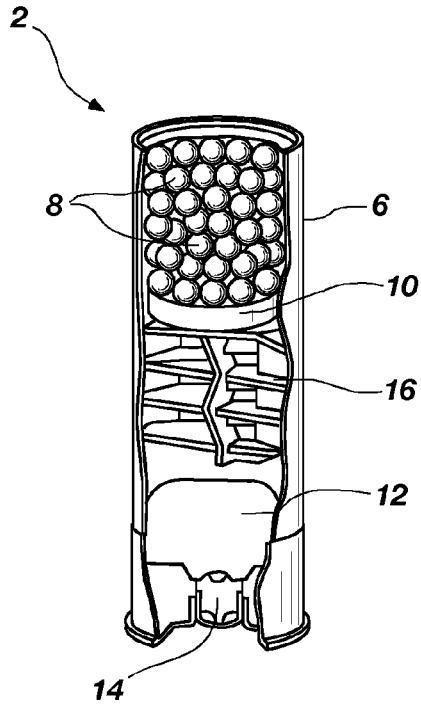

Reactive materials and a shot shell that includes the reactive material are disclosed. FIGS. 1-3 illustrate embodiments of shot shells 2 according to the present invention. The shot shell 2 includes a slug 4 and a case 6, as illustrated in FIG. 1, shot 8 and the case 6, as illustrated in FIG. 2, or the slug 4, the shot 8, and the case 6, as illustrated in FIG. 3. As used herein, the term "shot shell" denotes a shell carrying a slug 4, shot 8, or both a slug 4 and shot 8. In one embodiment, shot shell 2 also includes wad 10, a motive charge of gun powder 12, primer 14, and sabot 16. The shot shell 2 may be configured as a conventional shot shell, a medium caliber (35 mm, 30 mm, 25 mm, and 20 mm) projectile, or a 60 mm mortar anti personnel anti material ("MAPAM") round. The reactive material may also be used in larger caliber projectiles. In one embodiment, at least a portion of the slug 4, at least a portion of the shot 8, or at least a portion of the slug 4 and the shot 8 are formed from the reactive material. In addition, at least a portion of the case 6 may be formed from the reactive material. In the shot shell 2 illustrated in FIG. 1, the slug 4 may be formed from the reactive material or from a combination or mixture of the reactive material and a metal material. The metal material may be steel, tungsten, lead, copper, nickel, tin, or combinations thereof. The slug 4 may be formed into a desired configuration, such as a cylinder or a Foster slug, by pressing, casting, extruding, or injection molding.

In the shot shell 2 illustrated in FIG. 2, the shot 8 is formed from the reactive material or from the mixture of the reactive material and the metal material. The shot may be shaped into a cylinder, sphere, or other desired configuration by pressing, casting, extruding, or injection molding. The shot 8 in the shot shell 2 may be of a single size or a variety of sizes, providing increased surface area or mass when the shot 8 impacts a target. The shot 8 may also provide increased overpressure compared to the embodiment of the shot shell 2 where at least a portion of the slug 4 is formed from the reactive material or from the mixture of the reactive material and the metal material. If the shot 8 is formed from the mixture of the reactive material and the metal material, the shot shell 2 may have high reactivity and penetration. In the shot shell 2 illustrated in FIG. 3, the shot 8 may be formed from the reactive material, the metal material, or the mixture of the reactive material and the metal material. The shot 8 may be formed into the desired configuration by pressing, casting, extruding, or injection molding. The shot 8 may be embedded into a matrix of the reactive material, which forms the slug 4. Alternatively, the slug 4 may be formed from the metal material. Embedding the shot 8 in the reactive material provides increased post penetration fragmentation damage.

In one embodiment, the reactive material includes at least one binder and at least one fuel, at least one oxidizer, or combinations thereof The binder may be used in the reactive material to provide improved processability, safety, or performance. However, the binder is optional, such as if the reactive material is to be pressed into the desired configuration. As such, if the reactive material is to be pressed, the reactive material may include at least one fuel and at least one oxidizer or at least two fuels. The reactive material may be an intermetallic composition or a thermitic composition, or the like. As used herein, the term "intermetallic composition" refers to a composition that includes at least two metals that exothermically react when the composition is combusted. As used herein, the term "thermitic composition" refers to a composition that includes a metal and a metal oxide that exothermically react when the composition is combusted.

If the reactive material is to be cast into the desired configuration, the binder may account for from approximately 5% by weight ("wt %") to approximately 30 wt % of the reactive material. Percentages of each of the ingredients in the reactive material are expressed as percentages by weight of a total weight of the reactive material. If the reactive material is to be extruded or injection molded into the desired configuration, the binder may account for from approximately 15 wt % to approximately 80 wt % of the reactive material. If the reactive material is to be pressed into the desired configuration, the binder may account for from approximately 0 wt % to approximately 15 wt % of the reactive material.

The binder, if present, may be a curable organic binder, a thermoplastic fluorinated binder, a nonfluorinated organic binder, a fusible metal alloy, an epoxy resin, silicone, nylon, or combinations thereof. The binder may be a high-strength, inert material including, but not limited to, polyurethane, epoxy, silicone, or a fluoropolymer. Alternatively, the binder may be an energetic material, such as glycidyl azide polymer ("GAP") polyol. The binder may enable the reactive material to be pressed, cast, or extruded into a desired shape. The thermoplastic fluorinated binder may include, but is not limited to, polytetrafluoroethylene ("PTFE"); a thermoplastic terpolymer of tetrafluoroethylene, hexafluoropropylene, and vinylidene fluoride ("THV"); perfluorosuccinyl polyether dialcohol; a fluoroelastomer; or combinations thereof. Examples of thermoplastic fluorinated binders include, but are not limited to TEFLON®, which is available from DuPont (Wilmington, Del.); THV 220, THV 415, or THV 500, which are available from Dyneon LLC (Oakdale, Minn.); VITON®, which is a copolymer of vinylidenefluoride-hexafluoropropylene and is available from DuPont Dow Elastomers LLC (Wilmington, Del.); FLUOROLINK® C, which is a fluorinated polymer of perfluoropolyether ("PFPE") and is available from Solvay Solexis, Inc. (Thorofare, N.J.); or L-9939, which is perfluorosuccinyl polyether di-alcohol and is commercially available from 3M (St. Paul, Minn.). L-9939 is a mixture of hydroxy-functional perfluoropolyether oligomers of average structure: $HOCH_2CF(CF_3)OCF_2CF_2CF_2CF_2OCF(CF_3)CF_2OCF(CF_3)\ CF_2OCF(CF_3)CF_2OCF(CF_3)CH_2OH$ (or $C_{19}H_6O_7F_{34}$). If L-9939 is used as the binder, an isocyanate, such as DESMODUR® N-100 or DESMODUR® N-3200 (available from Mobay Chemical Co. (Pittsburgh, Pa.)), may be used to cure the L-9939. If FLUOROLINK® C is used as the binder, ERL (Huntsman Advanced Materials) may be used as a curative. For the sake of example only, the reactive material may be an epoxy-based composition or a fluoropolymer-based composition.

Fusible metal alloys are known in the art and are commercially available from sources including, but not limited to, Indium Corp, of America (Utica, N.Y.), Alchemy Castings (Ontario, Canada), and Johnson Mathey PLC (Wayne, Pa.). The fusible metal alloy may be a eutectic or a noneutectic alloy and may include transition metals and post-transition metals, such as metals from Group III, Group IV, and/or Group V of the Periodic Table of the Elements. The metals used in the fusible metal alloy may include, but are not limited to, bismuth ("Bi"), lead ("Pb"), tin ("Sn"), cadmium ("Cd"), indium ("In"), mercury ("Hg"), antimony ("Sb"), copper ("Cu"), gold ("Au"), silver ("Ag"), zinc ("Zn"), and mixtures thereof. For the sake of example only, the fusible metal alloy may be Wood's Metal, which has 50% Bi, 25% Pb, 12.5% Sn, and 12.5% Cd and is available from Sigma-Aldrich Co. (St. Louis, Mo.). Wood's Metal has a melting point of approximately 70° C. and a density of 9.58 g/cm$^3$. The fusible metal alloy may also be INDALLOY® 174, which includes 57% Bi, 26% In, and 17% Sn. INDALLOY® 174 has a melting point of 174° F. (approximately 79° C.), a density of 8.54 g/cm$^3$, and is commercially available from Indium Corp. of America. Other INDALLOY® materials are available from Indium Corp. of America and may be used in the reactive material. INDALLOY® materials are available in a range of melting points (from approximately 60° C. to approximately 300° C.) and include a variety of different metals.

The term "epoxy system" is used herein to refer to the epoxy resin, a cure catalyst, and a curative. For the sake of example only, the epoxy resin may be a fluorinated thermoset epoxy resin, a diglycidyl ether of bisphenol F ("DGEBF") ($C_{13}H_{12}O_2$), a diglycidyl ether of bisphenol A ("DGEBA") ($(CH_3)_2C(C_6H_4OH)_2$) perfluorosuccinyl polyether di-alcohol, or combinations thereof. The cure catalyst and the curative may be selected depending on the epoxy resin that is used. For the sake of example only, the curative may be a polyester or a polyetheramine and the cure catalyst may be a Lewis acid, triphenylbismuth, or alkyltin compound, such as dibutyl tin dilaurate ("DBTDL"). DGEBF is commercially available from Hexion Specialty Chemicals, Inc. (Houston, Tex.), under the tradename EPON®, such as EPON® 862, EPON® 815C, EPON® 8132, or EPON® 828. If an EPON® resin is used, EPIKURE® Curing Agent 3234 (triethylene tetramine) may be used as the curative, which is commercially available from Hexion Specialty Chemicals, Inc. DGEBA is commercially available from Huntsman Advanced Materials (Brewster, N.Y.) under the ARALDITE® tradename, such as ARALDITE® LY 1556 or ARALDITE® LY 6010. If an ARALDITE® resin is used, an anhydride hardener, such as ARADUR® 917 (Huntsman Advanced Materials), may be used as the curative and an imidazole accelerator, such as Accelerator DY 070 (Huntsman Advanced Materials), may be used as the cure catalyst. The epoxy system may include 100 parts by weight ARALDITE® LY1556, 90 parts by weight ARADUR® 917, and from 0.5 parts by weight to 2 parts by weight Accelerator DY 070. A polyetheramine, such as JEFFAMINE® D-230, JEFFAMINE® D-400, or JEFFAMINE® T-403, may alternatively be used as the curative. In one embodiment, the epoxy system includes ARALDITE® LY 1556, ARADUR® 917, and Accelerator DY 070.

The fuel may be present in the reactive material from approximately 5 wt % to approximately 90 wt %, depending on the type of fuel that is used, such as from approximately 6 wt % to approximately 83 wt %. The fuel may be a metal, an organic fuel, sulfur ("S"), or mixtures thereof. The metal used as a fuel may be hafnium ("Hf"), aluminum ("Al"), tungsten ("W"), zirconium ("Zr"), magnesium ("Mg"), boron ("B"), titanium ("Ti"), tantalum ("Ta"), nickel ("Ni"), Zn, Sn, silicon ("Si"), palladium ("Pd"), Bi, iron ("Fe"). Cu, phosphorous ("P"), osmium ("Os"), magnalium (an alloy of Al and Mg), an alloy of Zr and Ni, or combinations thereof. For instance, aluminum may be used in combination with other elements, such as hafnium, boron, or zirconium, to produce intermetallic-type reactive materials. The metal may be used in a powdered form and may have a particle size ranging from approximately 20 nm to approximately 300 μm. For the sake of example only, the metal may be present in the reactive material in an amount ranging from approximately 10% to approximately 90%. Alternatively, the fuel may be an organic fuel, such as phenolphthalein or hexa(ammine)cobalt(III)nitrate ("HACN"). The organic fuel may be present in the reactive material from approximately 15% to approximately 80%.

The oxidizer may be present in the reactive material from approximately 10% to approximately 81%, depending on the oxidizer used. The oxidizer may be an inorganic oxidizer, such as an ammonium nitrate, an alkali metal nitrate, an alkaline earth nitrate, an ammonium perchlorate, an alkali metal perchlorate, an alkaline earth perchlorate, an ammonium peroxide, an alkali metal peroxide, or an alkaline earth peroxide. The inorganic oxidizer may include, but is not limited to, ammonium Perchlorate ("AP"), potassium perchlorate ("KP"), potassium nitrate ("$KNO_3$"), sodium nitrate, cesium nitrate, or strontium nitrate ("$SrNO_3$"). The inorganic oxidizer may have a particle size ranging from approximately 1 μm to approximately 250 μm. The perchlorate or nitrate inorganic oxidizer may be present in the reactive material at from approximately 10% to approximately 90%. The inorganic oxidizer may also be a transition metal-based oxidizer, such as a copper-based, an iron-based, a tungsten-based, or a molybdenum-based oxidizer. Examples of such oxidizers include, but are not limited to, basic copper nitrate ($[Cu_2(OH)_3NO_3]$) ("BCN"), cupric oxide ("CuO"), cuprous oxide ("$Cu_2O$"), iron oxide ("$Fe_2O_3$"), tungsten dioxide ("$WO_2$"), tungsten trioxide ("$WO_3$"), hafnium oxide ("$HfO_2$"), bismuth trioxide ("$Bi_2O_3$"), or molybdenum trioxide ("$MoO_3$"). The transition metal-based oxidizer may be present from approximately 18% to approximately 78%. The transition metal-based oxidizer may have a particle size ranging from approximately 20 nm to approximately 200 μm.

The reactive material may, optionally, include a class 1.1, detonable energetic material, such as a nitramine or a nitrocarbon. The energetic material may include, but is not limited to, trinitrotoluene ("TNT"); cyclo-1,3,5-trimethylene-2,4,6-trinitramine ("RDX"); cyclotetramethylene tetranitramine ("HMX"); hexanitrohexaazaisowurtzitane ("CL-20"); 4,10-dinitro-2,6,8,12-tetraoxa-4,10-diazatetracyclo-[5.5.0.0$^{5,9}$.0$^{3,11}$]-dodecane ("TEX"); 1,3,3-trinitroazetine ("TNAZ"); ammonium dinitramide ("ADN"); 2,4,6-trinitro-1,3,5-benzenetriamine ("TATB"); dinitrotoluene ("DNT"); dinitroanisole ("DNAN"); or combinations thereof. If present, the energetic material may account for from approximately 0 wt % to approximately 70 wt % of the reactive material, such as from approximately 0 wt % to approximately 20 wt % of the reactive material.

The reactive material may optionally include additional ingredients, such as at least one of an energetic or nonenergetic binder, a processing aid, and a plasticizer, depending on the fuel(s), oxidizer(s), or binder(s) employed and the desired properties of the reactive material. Examples of energetic binders and nonenergetic binders that may be used include, but are not limited to, polyurethanes, epoxies, GAP, silicone, polyesters, nylons, cellulose acetate butyrate ("CAB"), cellulose butyrate nitrate ("CBN"), ethyl cellulose, bisazidomethyloxetane ("BAMO"), and fluoropolymers. Examples of processing aids include, but are not limited to, silicone, graphite, and PTFE. The plasticizer may include, but is not limited to, (bis(2,2-dinitropropyl)-acetal/bis-(2,2-dinitropropyl)formal) ("BDNPA/F"), glycidylazide plasticizer, and polyglycidyl nitrate ("PGN"). The reactive material may also, optionally, include glass, such as a glass fiber or a glass powder. For the sake of example only, the glass powder may be CAB-O-SIL® T720, which is commercially available from Cabot Corp. (Boston, Mass.).

The reactive material may include at least one fuel and PTFE. In one embodiment, the reactive material includes Al, W, Ta, Ni, or combinations thereof and PTFE.

The reactive material may include at least one fuel and THV. In another embodiment, the reactive material includes Al, Ta, Bf, Zr, Ti, W, B, Si, Os, a Zr/Ni alloy, or combinations thereof and a THV polymer such as THV 220. THV 550, or combinations thereof. An inorganic oxidizer, such as CuO, KP, $MoO_3$, $WO_3$, $Fe_2O_3$, $HfO_2$, or combinations thereof, may optionally be present.

The reactive material may include at least one fuel and an epoxy, such as DGEBA. In another embodiment, the reactive material includes W, Zr, Ni, Al, Ta, Hf, or combinations thereof and a DGEBA epoxy system, such as ARALDITE® LY 1556, ARADUR® 917, and Accelerator DY 070. An inorganic oxidizer, such as KP, CuO, $Bi_2O_3$, or combinations thereof, may optionally be present. Glass, such as glass powder or glass fibers, may optionally be present. In addition, a THV polymer, such as THV 220, THV 550, or combinations thereof, may optionally be present.

In another embodiment, the reactive material includes an oxidizer, such as KP, and a fusible metal alloy, such as INDALLOY® 174. S may optionally be present.

In another embodiment, the reactive material includes Ta and a fluorinated polymer of PFPE, such as FLUOROLINK® C.

The reactive material may include at least one fuel and perfluorosuccinyl polyether di-alcohol. In another embodiment, the reactive material includes Zr, Al, Ni, Hf, W, or combinations thereof and perfluorosuccinyl polyether di-alcohol, such as L-9939. An inorganic oxidizer, such as CuO, K, or combinations thereof, may optionally be present.

The reactive material may include at least one fuel and a copolymer of vinylidenefluoride-hexafluoropropylene. In another embodiment, the reactive material includes W, CuO, and a copolymer of vinylidenefluoride-hexafluoropropylene, such as VITON® A.

In another embodiment, the reactive material includes a fuel, such as Ta or Fe, and at least one oxidizer, such as KP, $WO_3$, $WO_2$, or $Fe_2O_3$. Specific examples of such reactive materials include Ta and $WO_3$; Ta and $WO_2$; Ta and $Fe_2O_3$; and KP and Fe. In another embodiment, the reactive material may include at least two fuels, such as combinations of Zr, Al, Ti, Ni, Cu, W, and Fe. Specific examples of such reactive materials include Zr and Ni; Al and Ti; Ti and Cu; Al, Ti, and W; and Al and Fe.

The reactive material may be one or more materials as set forth in the following United States Patents and Patent Applications, the disclosure of each of which is incorporated by reference herein in its entirety: U.S. Pat. No. 6,593,410; U.S. Pat. No. 6,962,634; U.S. patent application Ser. No. 10/801,948 entitled "Reactive Material Enhanced Munition Compositions and Projectiles Containing Same," filed Mar. 15, 2004; U.S. patent application Ser. No. 10/801,946, entitled "Reactive Compositions Including Metal and Methods of Forming Same," filed Mar. 15, 2004; U.S. patent application Ser. No. 11/079,925, entitled "Reactive Material Enhanced Projectiles and Related Methods," filed Mar. 14, 2005; U.S. patent application Ser. No. 11/538,763, entitled "Reactive Material Enhanced Projectiles And Related Methods," filed Oct. 4, 2006; and U.S. patent application Ser. No. 11/512,058 entitled "Weapons And Weapon Components Incorporating Reactive Materials And Related Methods," filed Aug. 29, 2006.

Additional examples of reactive materials are described in Table 1.

TABLE 1

Reactive Material Formulations.

| Formulation | Ingredients (wt %) |
|---|---|
| 1 | Al (26) |
| | PTFE (74) |
| 2 | Al (44.1) |
| | PTFE (55.9) |
| 3 | W (71.6) |
| | PTFE (28.4) |
| 4 | Ta (68.4) |
| | PTFE (31.6) |
| 5 | Al (31.6) |
| | THV 220 (68.4) |
| 6 | Ta (74) |
| | THV 220 (26) |
| 7 | Hf (69.5) |
| | THV 220 (30.5) |
| 8 | Zr (52.6) |
| | THV 220 (47.4) |
| 9 | Al (11.6) |
| | PTFE (88.4) |
| 10 | Al (28.3) |
| | PTFE (71.7) |
| 11 | Al (22.6) |
| | 95:5 THV 500:220 (65.5) |
| | Ti (11.9) |
| 12 | Ta (73.8) |
| | THV 500 (24.9) |
| | THV 220 (1.3) |
| 13 | Hf (69.1) |
| | THV 550 (29.3) |
| | THV 220 (1.5) |
| 14 | Zr (52.2) |
| | THV 500 (45.4) |
| | THV 220 (2.4) |
| 15 | Ni (34.3) |
| | Al (23.2) |
| | PTFE (42.6) |
| 16 | Ni (25.2) |
| | Al (13.8) |
| | PTFE (61) |

TABLE 1-continued

Reactive Material Formulations.

| Formulation | Ingredients (wt %) |
|---|---|
| 17 | Zr (63.9) |
| | THV 500 (34.3) |
| | THV 220 (1.8) |
| 18 | W (71.4) |
| | KP (10) |
| | Zr (10) |
| | Epoxy System[a] (8.4) |
| | CAB-O-SIL ® T720 (0.2) |
| 19 | Ni (57.5) |
| | Al (26.5) |
| | Epoxy System[a] (16) |
| 20 | W (82.9) |
| | KP (4.2) |
| | Zr (4.2) |
| | Epoxy System[a] (7.6) |
| | Glass fiber (1.0) |
| 21 | W (10) |
| | CuO (34.9) |
| | Zr (41) |
| | Epoxy System[a] (14.2) |
| 22 | W (40) |
| | CuO (19) |
| | Zr (22.3) |
| | Epoxy System[a] (18.8) |
| 23 | W (6.7) |
| | Ni (49.8) |
| | Al (23.4) |
| | Epoxy System[a] (20.1) |
| 24 | W (10) |
| | CuO (34.1) |
| | Zr (40) |
| | Epoxy System[a] (15.9) |
| 25 | W (60) |
| | CuO (10) |
| | Zr (10) |
| | THV 220 (20) |
| 26 | W (79) |
| | CuO (3) |
| | Zr (3) |
| | THV 220 (15) |
| 27 | W (84) |
| | THV 220 (16) |
| 28 | W (84) |
| | THV 220 (1.5) |
| | THV 500 (14.5) |
| 29 | W (60) |
| | CuO (10) |
| | Zr (10) |
| | 95:5 THV 500:220 (20) |
| 30 | Ni (42) |
| | Al (22) |
| | KP (20) |
| | Epoxy System[a] (16) |
| 31 | CuO (38.5) |
| | Zr (45.2) |
| | Epoxy System[a] (16.4) |
| 32 | W (72.4) |
| | CuO (9.9) |
| | Zr (9.9) |
| | Epoxy System[a] (7.7) |
| 33 | W (83.2) |
| | CuO (5) |
| | Zr (5) |
| | Epoxy System[a] (6.0) |
| | Glass fiber (0.75) |
| 34 | W (73.6) |
| | CuO (10) |
| | Zr (10) |
| | Epoxy System[a] (6.3) |
| | CAB-O-SIL ® T720 (0.1) |
| 35 | W (71.7) |
| | CuO (10) |
| | Al (10) |
| | Epoxy System[a] (8.2) |
| | CAB-O-SIL ® T720 (0.1) |

TABLE 1-continued

Reactive Material Formulations.

| Formulation | Ingredients (wt %) |
|---|---|
| 36 | W (71.1) |
| | CuO (10) |
| | THV 500 (10) |
| | Epoxy System[a] (8.8) |
| | CAB-O-SIL ® T720 (0.2) |
| 37 | Hf (78.6) |
| | THV 220 (21.4) |
| 38 | W (72.1) |
| | Ni (10) |
| | Al (10) |
| | Epoxy System[a] (7.8) |
| | CAB-O-SIL ® T720 (0.1) |
| 39 | Ta (70.3) |
| | Zr (10) |
| | CuO (10) |
| | Epoxy System[a] (9.6) |
| | CAB-O-SIL ® T720 (0.1) |
| 40 | Hf (69.1) |
| | Zr (10) |
| | CuO (10) |
| | Epoxy System[a] (10.8) |
| | CAB-O-SIL ® T720 (0.1) |
| 41 | W (50) |
| | Ni (20) |
| | Al (10) |
| | Epoxy System[a] (10) |
| | KP (10) |
| 42 | W (64.1) |
| | Al (5) |
| | THV 220 (25.9) |
| | KP (5) |
| 43 | W (54.2) |
| | Al (10) |
| | THV 220 (30.8) |
| | KP (5) |
| 44 | W (50.6) |
| | Zr (10) |
| | THV 220 (29.4) |
| | KP (10) |
| 45 | W (67.4) |
| | Zr (5) |
| | THV 220 (22.6) |
| | KP (5) |
| 46 | W (60.8) |
| | Zr (10) |
| | THV 220 (24.2) |
| | KP (5) |
| 47 | Al (13.9) |
| | Ni (29.5) |
| | PTFE (56.6) |
| 48 | Al (2) |
| | Ni (4.25) |
| | W (76.8) |
| | PTFE (17) |
| 49 | Al (28.8) |
| | Ni (34.2) |
| | PTFE (37) |
| 50 | Hf (69.2) |
| | THV 500 (30.9) |
| 51 | Zr (52.2) |
| | THV 500 (47.8) |
| 52 | Al (22.8) |
| | THV 500 (65.3) |
| | $MoO_3$ (12) |
| 53 | Al (22.8) |
| | THV 500 (65.3) |
| | Ti (12) |
| 54 | Ti (25) |
| | THV 500 (65) |
| | B (10) |
| 55 | W (72.4) |
| | THV 500 (27.6) |
| 56 | Ta (49.4) |
| | $WO_3$ (50.6) |
| 57 | Ta (75) |
| | $WO_3$ (25) |

TABLE 1-continued

Reactive Material Formulations.

| Formulation | Ingredients (wt %) |
|---|---|
| 58 | Ta (51) |
| | THV 500 (30.4) |
| | $WO_3$ (17) |
| | THV 220 (1.6) |
| 59 | Hf (87.1) |
| | THV 500 (12.3) |
| | THV 220 (0.65) |
| 60 | Ti (26.9) |
| | THV 500 (59.3) |
| | B (10.8) |
| | THV 220 (3.1) |
| 61 | W (72.5) |
| | THV 500 (26.2) |
| | THV 220 (1.4) |
| 62 | W (65.6) |
| | THV 500 (32.7) |
| | THV 220 (1.7) |
| 63 | W (83.2) |
| | THV 500 (16) |
| | THV 220 (0.8) |
| 64 | $WO_3$ (40.5) |
| | THV 500 (56.6) |
| | THV 220 (3) |
| 65 | Ta (49.4) |
| | $Fe_2O_3$ (50.6) |
| 66 | Ta (40.2) |
| | $WO_2$ (59.8) |
| 67 | Ta (68.5) |
| | $WO_2$ (31.5) |
| 68 | Ta (89.4) |
| | THV 500 (10.1) |
| | THV 220 (0.5) |
| 69 | Ta (90.6) |
| | Epoxy System[b] (9.4) |
| 70 | W (87.1) |
| | THV 500 (12.3) |
| | Zr (0.7) |
| 71 | W (75) |
| | THV 220 (5) |
| | KP (20) |
| 72 | W (78.5) |
| | THV 220 (2) |
| | KP (19.5) |
| 73 | INDALLOY ® 174 (60) |
| | KP (40) |
| 74 | INDALLOY ® 174 (80) |
| | KP (20) |
| 75 | INDALLOY ® 174 (90) |
| | KP (10) |
| 76 | W (41.3) |
| | VITON A (5) |
| | CuO (53.7) |
| 77 | W (89.7) |
| | VITON A (5) |
| | CuO (5.3) |
| 78 | W (22.6) |
| | Al (9.4) |
| | $HfO_2$ (36.9) |
| | 95:5 THV 500:THV 220 (31.1) |
| 79 | W (47) |
| | Si (14.4) |
| | $HfO_2$ (10) |
| | 95:5 THV 500:THV 220 (28.6) |
| 80 | Zr (70) |
| | Ni (30) |
| 81 | Al (2) |
| | Ni (4.3) |
| | W (78.1) |
| | 95:5 THV 500:THV 220 (15.6) |
| 82 | Al (30) |
| | Ni (60) |
| | W (10) |
| 83 | Al (53) |
| | Ti (47) |
| 84 | Ti (75) |
| | Cu (25) |

TABLE 1-continued

Reactive Material Formulations.

| Formulation | Ingredients (wt %) |
|---|---|
| 85 | W (66) |
| | Al (2.9) |
| | $Fe_2O_3$ (8.5) |
| | 95:5 THV 500:THV 220 (22.7) |
| 86 | Zr/Ni alloy (10) (Zr:Ni 44:56 (Zr:2Ni)) |
| | Al (5) |
| | W (65) |
| | 95:5 THV 500:THV 220 (20) |
| 87 | Hf (78.4) |
| | THV 500 (20.6) |
| | THV 220 (1.1) |
| 88 | Os (81.8) |
| | THV 500 (17.3) |
| | THV 220 (0.9) |
| 89 | Zr (66.3) |
| | THV 500 (32.0) |
| | THV 220 (1.7) |
| 90 | Al (15) |
| | Ti (13.3) |
| | W (71.7) |
| 91 | W (71.4) |
| | KP (10) |
| | Epoxy System[a] (8.4) |
| | Zr (10) |
| 92 | W (71.4) |
| | $Bi_2O_3$ (10) |
| | Epoxy System[a] (8.4) |
| | Zr (10) |
| 93 | Al (40) |
| | Iron (60) |
| 94 | KP (14) |
| | Iron (86) |
| 95 | Al (36.1) |
| | CuO (24.1) |
| | L-9939 (39.8) |
| 96 | Zr (44.2) |
| | CuO (29.4) |
| | L-9939 (26.4) |
| 97 | Ni (46.1) |
| | CuO (30.7) |
| | L-9939 (23.2) |
| 98 | Hf (85.2) |
| | L-9939 (14.8) |
| 99 | Zr (73.7) |
| | L-9939 (26.3) |
| 100 | Hf (69.3) |
| | Al (10) |
| | L-9939 (20.7) |
| 101 | Hf (68.9) |
| | KP (10) |
| | L-9939 (21.1) |
| 102 | W (68.2) |
| | KP (10) |
| | Zr (10) |
| | L-9939 (11.9) |
| 103 | INDALLOY ® 174 (90) |
| | S (5) |
| | KP (5) |
| 104 | W-90 μm (61.4) |
| | W-6-8 μm (9.0) |
| | Zr-type GA (10.9) |
| | KP-20 μm (8.8) |
| | L-9939 (6.6) |
| | DESMODUR ® N-100 (3.3) |
| | DBTDL (0.0001) |
| 105 | W-90 μm (49.4) |
| | W-6-8 μm (21.2) |
| | Al-H-95 (12.3) |
| | KP-20 μm (5.3) |
| | L-9939 (8.0) |
| | DESMODUR ® N-100 (4.0) |
| | DBTDL (0.0001) |

TABLE 1-continued

Reactive Material Formulations.

| Formulation | Ingredients (wt %) |
|---|---|
| 106 | W-90 μm (46.7) |
| | W-6-8 μm (20.0) |
| | Zr-type GA (11.1) |
| | KP-20 μm (8.9) |
| | L-9939 (8.8) |
| | DESMODUR ® N-100 (4.4) |
| | DBTDL (0.0001) |
| 107 | Al (25) |
| | $Bi_2O_3$ (59) |
| | Epoxy System[a] (16) |
| 108 | Hf (72) |
| | $Bi_2O_3$ (16) |
| | Epoxy System[a] (12) |
| 109 | Zr (50) |
| | CuO (15) |
| | W (25) |
| | Epoxy System[a] (10) |
| 110 | W (70.4) |
| | Zr (10.9) |
| | KP (8.8) |
| | L-9939 (9.9) |
| 111 | Zr (40) |
| | CuO (15) |
| | W (35) |
| | Epoxy System[a] (10) |

[a]ARALDITE ® LY 1556, ARADUR ® 917, and Accelerator DY 070
[b]FLUOROLINK ® C and ERL Relative amounts of the ingredients (fuel, oxidizer, binder) and any optional ingredients may be varied depending on the desired properties of the reactive material. The reactivity of the formulation may be adjusted by varying the ratio of fuel to oxidizer, ingredient particle size, and mechanical properties of the reactive material. Relative amounts of the ingredients of the reactive material may be optimized as well as the associated processing techniques, to enable precise control of porosity, density, strength, reactivity, and fracture toughness. As such, the penetration and reactivity of the shot shell 2 may be optimized and tailored for specific operations.

The reactive material may be formulated by mixing the ingredients and any optional ingredients. The reactive material may be formed into a desired shape or may be loaded into the shot shell 2 by conventional techniques, such as by casting, pressing, extruding, or injection molding. For the sake of example only, to form a castable reactive material, a fluorinated thermoset epoxy or a silicone may be used as the binder. For the sake of example only, to form an extrudable reactive material, a thermoplastic fluoropolymer, such as THV, may be used as the binder. For the sake of example only, if the reactive material does not include a binder, the reactive material may be pressed into the desired shape.

In one embodiment, the slug 4 and/or shot 8 of reactive material of the shot shell 2 is configured to survive gun launch when shot or fired, but to rapidly break up as the shot shell 2 penetrates an outer surface of the target, producing heat and pressure on the backside of the target. As such the slug 4 and/or shot 8 may more easily penetrate or breach the target than a conventional shot shell. The slug 4 and/or shot 8 may react upon hitting the target, providing larger or comparable entry holes and/or exit holes than a conventional shot shell. The slug 4 and/or shot 8 including the reactive material may provide an increased reaction with the interior of the target rather than with the surface(s) of the target. In addition, less shrapnel is produced on the backside of the target, causing less damage to the backside of the target and lower collateral damage, such as to personnel in proximity to the backside of the target.

The shot shell 2 may be used to penetrate targets formed from a variety of materials, such as metal, wood, cinder, or combinations thereof. Metal materials include, but are not limited to, corrugated metal, steel, aluminum, or stainless steel. The target may also be formed from cinder, such as cinder blocks, fiberglass, or glass. The target may be a door (a two-panel door, a corrugated metal door, a steel door, an aluminum door, or a stainless steel door), a vehicle (a car, an aircraft, or a watercraft), an incoming missile or other projectile, a wall, a building, or a fuel storage container. The slug 4 and/or shot 8 of shot shell 2 may penetrate the target having a thickness with a range of from approximately 0.063 inch to approximately 5 inches, depending upon the material of the target. For instance, if the target is a vehicle or a gas tank, the slug 4 and/or shot 8 may penetrate thin-skinned metal having a thickness of less than approximately 0.125 inch. If the target is a wood door, the slug 4 and/or shot 8 may penetrate wood having a thickness of up to approximately 1.5 inches. If the target is a wall, the slug 4 and/or shot 8 may penetrate cinder blocks having a thickness of up to approximately 5 inches. When fired, the slug 4 and/or shot 8 may, depending on the motive charge employed, have a velocity that ranges from approximately 1100 ft/sec to approximately 2240 ft/sec, such as from approximately 1500 ft/sec to approximately 2200 ft/sec. The slug 4 and/or shot 8 may penetrate the target when fired from a distance of less than approximately 25 feet (less than approximately 7.6 m). However, the slug 4 and/or shot 8 may also penetrate the target when fired from greater distances, such as up to approximately 164 feet (up to approximately 50 m) from the target.

The shot shell 2 may enable a user to more easily breach a door or disable a vehicle than a conventional shot shell. By incorporating the reactive material into the slug 4 and/or shot 8 of the shot shell 2, a reduced number of shot shell rounds may be used to breach the target, such as a locked door, compared to the number of conventional shot shells rounds needed to breach the target. The shot shell 2 may also provide reduced ricochet compared to the conventional shot shell. When fired, the shot shell 2 may have a decreased amount of back spray compared to the conventional shot shell, providing additional safety for a shooter of the shot shell. Unlike conventional door breaching shot shell rounds, the shot shell 2 is classified as a flammable solid, rather than as a class 1.4S explosive and, thus, is subject to less stringent procedures for shipping and handling.

The following examples serve to explain embodiments of the present invention in more detail. These examples are not to be construed as being exhaustive or exclusive, or otherwise limiting, as to the scope of this invention.

EXAMPLES

Example 1

Production of Formulations 1-111

The formulations shown in Table 1 were produced by mixing the indicated percentages of the listed ingredients. Each of the formulations was subjected to safety and performance testing. Formulations having desirable pressure generation, high strength, and lower cost were selected for the testing described below.

Example 2

Projectile Data for Reactive Material Slugs

Each of Formulations 18, 25, 34, 37, 42, and 75 was cast into a cylinder-shaped slug or a Foster slug and loaded into a shot shell 2, which was fired from a Mossburg 12-Gauge shotgun having a 20-inch barrel. The shot shell 2 was fired at a wood or metal target, such as at a steel door, a stainless steel ("SS") door, an aluminum ("Al") door, or a two-panel door. The shotgun was positioned between 21 feet and 21.5 feet from the target. For comparison, a shot shell including a lead slug was also fired against the target. The velocity of the slugs was measured approximately 10 feet from the target and is shown in Table 2.

TABLE 2

Projectile Data for Reactive Material Slugs.

| Formulation | Configuration | Wt (g) | Slug Wt (grn) | Target | Target Thickness | Velocity (ft/sec) |
|---|---|---|---|---|---|---|
| Lead | Foster | — | — | Steel | 0.063 | 1554 |
| Lead | Foster | — | — | SS | 0.072 | 1537 |
| Lead | Foster | — | — | Al | 0.250 | 1555 |
| Lead | Foster | — | — | Steel | 0.063 | 1576 |
| Lead | Foster | — | — | Steel | 0.063 | 1555 |
| Lead | Foster | — | — | 2 panel door | 1.75 | 1610 |
| 37 | Foster | 18.49 | 285 | Steel | 0.063 | 1597 |
| 37 | Foster | 18.47 | 285 | Steel | 0.063 | 1676 |
| 37 | Foster | 18.51 | 286 | SS | 0.072 | 1639 |
| 37 | Foster | 18.50 | 286 | Al | 0.250 | 1634 |
| 37 | Foster | 18.50 | 286 | 2 panel door | 1.750 | 1592 |
| 25 | Foster | 18.95 | 292 | Steel | 0.063 | 1560 |
| 25 | Foster | 19.94 | 308 | SS | 0.072 | 1595 |
| 25 | Foster | 18.16 | 280 | Steel | 0.063 | 1503 |
| 25 | Foster | 18.33 | 283 | SS | 0.072 | 1610 |
| 34 | Foster | 24.40 | 377 | Steel | 0.063 | 1427 |
| 75 | Foster | 15.29 | 236 | Steel | 0.063 | 1528 |
| 75 | Foster | 15.34 | 237 | Steel | 0.125 | 1571 |
| 42 | Foster | 13.52 | 209 | Steel | 0.063 | 1631 |
| 42 | Foster | 13.48 | 208 | Steel | 0.125 | 1684 |
| 18 | Cylinder | 21.64 | 334 | Steel | 0.063 | 1649 |
| 18 | Cylinder | 21.64 | 334 | Steel | 0.125 | 1656 |
| 18 | Cylinder | 21.53 | 332 | 2 panel door | 0.125 | 1689 |
| 18 | Cylinder | 21.87 | 338 | 2 panel door | 1.750 | 2232 |
| 18 | Cylinder | 21.70 | 335 | 2 panel door | 1.750 | 1650 |
| 18 | Cylinder | 22.06 | 341 | 2 panel door | 1.750 | 1654 |

The slugs 4 including the reactive material formulations survived gun launch, reacted upon impact with the targets, and penetrated the targets. In addition, Formulation 20 produced a very large exit hole when tested on a metal door and produced a large and sustained plume size during reaction against all targets. In comparison, the lead slug produced a smaller exit hole. The slugs 4 including the reactive material formulations had comparable or faster velocities than the shot shells including the lead slug.

Example 3

Projectile Data for Reactive Material Slugs and Tungsten Shot Embedded in Reactive Material Slugs Formulation 18 was cast into a cylinder-shaped slug and loaded into a shot shell 2. The slug type is indicated in Table 3 as "RM." Approximately 50 pieces of tungsten shot were loaded into a shot shell 2 and Formulation 18 was cast around the tungsten shot, forming a slug having the same geometry as the RM slug, except having tungsten shot embedded in the slug. The former slug type is indicated in Table 3 as "Hybrid." Approximately 25 pieces of tungsten shot were loaded into the front half of a shot shell 2 and Formulation 18 was cast around the shot, forming a slug having the same geometry as the RM slug, except having tungsten shot embedded in the slug. The former slug type is indicated in Table 3 as "Hybrid Frontloaded." The shot shells 2 were fired from a Mossburg 12-Gauge shotgun having a 20-inch barrel. The shot shells 2 were fired at the indicated location (windshield, engine, fender, battery, fuel tank, coolant reservoir, door, or door lock) of a vehicle at the indicated distance from the vehicle. The velocity of the slugs/shot was approximately 1500 ft/sec±100 ft/sec.

TABLE 3

Slug Type, Range, Target, and Angle for Reactive Material Slugs and Tungsten Shot Embedded in Reactive Material Slugs.

| Slug type | Range | Target | Angle (degree) |
|---|---|---|---|
| Hybrid | 32 | Windshield | 45 |
| Hybrid | 15 | Engine through hood | 0 |
| Hybrid | 32 | Fender/Battery | 45 |
| Hybrid | 20 | Fuel Tank through Frame | 0 |
| Hybrid | 32 | Coolant Reservoir | 45 |
| Hybrid frontloaded | 15 | Driver-side Door | — |
| RM | 8 | Door Lock | — |
| RM | 32 | Windshield | 45 |

While the invention may be susceptible to implementation with various modifications and in various forms, specific embodiments have been shown by way of example in the drawings and have been described in detail herein. However it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A composition for a reactive material comprising at least one fuel, an epoxy resin selected from the group consisting of a diglycidyl ether of bisphenol A and a diglycidyl ether of bisphenol F, and at least one inorganic oxidizer.

2. The composition of claim 1, wherein the at least one fuel comprises a compound selected from the group consisting of hafnium, aluminum, tungsten, zirconium, magnesium, boron, titanium, sulfur, tantalum, nickel, zinc, tin, silicon, palladium, bismuth, iron, copper, phosphorous, osmium, magnalium, and an alloy of zirconium and nickel.

3. The composition of claim 1, wherein the at least one fuel comprises tungsten, zirconium, nickel, aluminum, tantalum, hafnium, and combinations thereof.

4. The composition of claim 1, further comprising at least one inorganic oxidizer selected from the group consisting of cupric oxide, bismuth trioxide, and potassium perchlorate.

5. The composition of claim 1, further comprising glass powder or glass fibers.

6. The composition of claim 1, further comprising a terpolymer of tetrafluoroethylene, hexafluoropropylene, and vinylidene fluoride.

7. The composition of claim 1, wherein the reactive material comprises tungsten, zirconium, a diglycidyl ether of bisphenol A, potassium perchlorate, and glass powder.

8. A composition for a reactive material, comprising:

at least one terpolymer of tetrafluoroethylene, hexafluoropropylene, and vinylidene fluoride and osmium.

9. A composition for a reactive material comprising at least one fuel and perfluorosuccinyl polyether di-alcohol.

10. The composition of claim 9, wherein the at least one fuel comprises a compound selected from the group consisting of hafnium, aluminum, tungsten, zirconium, magnesium, boron, titanium, sulfur, tantalum, nickel, zinc, tin, silicon, palladium, bismuth, iron, copper, phosphorous, osmium, magnalium, and an alloy of zirconium and nickel.

11. The composition of claim 9, wherein the at least one fuel comprises zirconium, aluminum, nickel, hafnium, tungsten, and combinations thereof.

12. The composition of claim 9, further comprising at least one inorganic oxidizer selected from the group consisting of cupric oxide and potassium perchlorate.

13. The composition of claim 9, wherein the reactive material comprises aluminum, cupric oxide, and perfluorosuccinyl polyether di-alcohol.

14. The composition of claim 9, wherein the reactive material comprises zirconium, cupric oxide, and perfluorosuccinyl polyether di-alcohol.

15. The composition of claim 9, wherein the reactive material comprises nickel, cupric oxide, and perfluorosuccinyl polyether di-alcohol.

16. The composition of claim 9, wherein the reactive material comprises hafnium and perfluorosuccinyl polyether di-alcohol.

17. The composition of claim 16, further comprising aluminum.

18. The composition of claim 16, further comprising potassium perchlorate.

19. The composition of claim 9, wherein the reactive material comprises zirconium and perfluorosuccinyl polyether di-alcohol.

20. The composition of claim 9, wherein the reactive material comprises tungsten, zirconium, potassium perchlorate, and perfluorosuccinyl polyether di-alcohol.

21. A shot shell comprising a case and at least one of a slug and shot received at least partially within the case:

at least a portion of the at least one of the slug and the shot formed from a reactive material wherein the reactive material comprises a composition from one of the following compositions:

at least one fuel, an epoxy resin selected from the group consisting of a diglycidyl ether of bisphenol A and a diglycidyl ether of bisphenol F, and at least one inorganic oxidizer;

at least one terpolymer of tetrafluoroethylene, hexafluoro-propylene, and vinylidene fluoride and osmium;

at least one fuel and a fluorinated polymer of perfluoropolyether;

at least one fuel and perfluorosuccinyl polyether di-alcohol;

at least one fuel, an epoxy resin selected from the group consisting of a diglycidyl ether of bisphenol A and a diglycidyl ether of bisphenol F, and glass powder or glass fibers; and at least two fuels and a diglycidyl ether of bisphenol A or a diglycidyl ether of bisphenol F.

22. The shot shell of claim 21, wherein the slug comprises the reactive material or a combination of the reactive material and a metal material.

23. The shot shell of claim 21, wherein the shot comprises the reactive material or a combination of the reactive material and a metal material.

24. The shot shell of claim 23, wherein the shot comprises the metal material embedded in the slug formed from the reactive material.

25. The shot shell of claim 21, wherein the at least one fuel is a compound selected from the group consisting of hafnium, aluminum, tungsten, zirconium, magnesium, boron, titanium, sulfur, tantalum, nickel, zinc, tin, silicon, palladium, bismuth, iron, copper, phosphorous, osmium, magnalium, and an alloy of zirconium and nickel.

26. The shot shell of claim 21, wherein the at least one inorganic oxidizer is a compound selected from the group consisting of ammonium perchlorate, potassium perchlorate, potassium nitrate, cupric oxide, iron oxide, tungsten dioxide, tungsten trioxide, hafnium oxide, bismuth trioxide, and molybdenum trioxide.

27. The shot shell of claim 22, wherein the metal material comprises steel, tungsten, lead, copper, nickel, tin, or combinations thereof.

28. The shot shell of claim 23, wherein the metal material comprises steel, tungsten, lead, copper, nickel, tin, or combinations thereof.

29. The shot shell of claim 21, wherein the reactive material comprises tungsten, tantalum, nickel, hafnium, aluminum, zirconium, or combinations thereof, a diglycidyl ether of bisphenol A, a diglycidyl ether of bisphenol F, or combinations thereof, and at least one inorganic oxidizer.

30. The shot shell of claim 21, wherein the reactive material comprises tantalum and a fluorinated polymer of perfluoropolyether.

31. The shot shell of claim 21, wherein the at least one fuel comprises zirconium, aluminum, nickel, hafnium, tungsten, or combinations thereof.

32. The shot shell of claim 31, further comprising at least one inorganic oxidizer selected from the group consisting of cupric oxide and potassium perchlorate.

33. The shot shell of claim 21, wherein the reactive material comprises aluminum, cupric oxide, and perfluorosuccinyl polyether di-alcohol.

34. The shot shell of claim 21, wherein the reactive material comprises zirconium, cupric oxide, and perfluorosuccinyl polyether di-alcohol.

35. The shot shell of claim 21, wherein the reactive material comprises nickel, cupric oxide, and perfluorosuccinyl polyether di-alcohol.

36. The shot shell of claim 21, wherein the reactive material comprises hafnium and perfluorosuccinyl polyether di-alcohol.

37. The shot shell of claim 36, wherein the reactive material further comprises aluminum.

38. The shot shell of claim 36, wherein the reactive material further comprises potassium perchlorate.

39. The shot shell of claim 21, wherein the reactive material comprises zirconium and perfluorosuccinyl polyether di-alcohol.

40. The shot shell of claim 21, wherein the reactive material comprises tungsten, zirconium, potassium perchlorate, and perfluorosuccinyl polyether di-alcohol.

41. A method of producing a shot shell, comprising:

producing a reactive material comprising a composition from one of the following compositions:

at least one fuel, an epoxy resin selected from the group consisting of a diglycidyl ether of bisphenol A and a diglycidyl ether of bisphenol F, and at least one inorganic oxidizer;

at least one terpolymer of tetrafluoroethylene, hexafluoropropylene, and vinylidene fluoride and osmium;

at least one fuel and a fluorinated polymer of perfluoropolyether;

at least one fuel and perfluorosuccinyl polyether dialcohol;

at least one fuel, an epoxy resin selected from the group consisting of a diglycidyl ether of bisphenol A and a diglycidyl ether of bisphenol F, and glass powder or glass fibers; and at least two fuels and a diglycidyl ether of bisphenol A or a diglycidyl ether of bisphenol F; and forming the reactive material into at least a portion of at least one of a slug and shot.

42. The method of claim 41, further comprising loading the at least one of the slug and the shot at least partially into a case.

43. A composition for a reactive material comprising tungsten, nickel, aluminum, an epoxy resin selected from the group consisting of a diglycidyl ether of bisphenol A and a diglycidyl ether of bisphenol F, and glass powder or glass fibers.

44. A composition for a reactive material comprising at least two metallic fuels and a diglycidyl ether of bisphenol A or a diglycidyl ether of bisphenol F.

45. The composition of claim 44, wherein the at least two metallic fuels comprise at least two of nickel, aluminum, and tungsten.

* * * * *